US009259096B2

(12) United States Patent
Cik

(10) Patent No.: US 9,259,096 B2
(45) Date of Patent: Feb. 16, 2016

(54) FOOD-GRADE POLYETHYLENE MATTRESS

(75) Inventor: Barry A. Cik, Beachwood, OH (US)

(73) Assignee: BJ2, LLC, University Heights, OH (US)

( * ) Notice: Subject to any disclaimer, the term of this patent is extended or adjusted under 35 U.S.C. 154(b) by 1315 days.

(21) Appl. No.: 12/044,456

(22) Filed: Mar. 7, 2008

(65) Prior Publication Data

US 2008/0216247 A1 Sep. 11, 2008

Related U.S. Application Data

(60) Provisional application No. 60/893,939, filed on Mar. 9, 2007, provisional application No. 60/939,418, filed on May 22, 2007.

(51) Int. Cl.
*A47C 27/00* (2006.01)
*A47C 31/00* (2006.01)

(52) U.S. Cl.
CPC ..... *A47C 27/002* (2013.01); *A47C 31/00* (2013.01)

(58) Field of Classification Search
CPC .. A47C 23/125; A47C 27/002; A47C 27/005; A47C 27/04; B32B 27/12; B32B 27/32; B32B 2250/04
USPC ..... 442/152, 153; 5/690, 698, 737
See application file for complete search history.

(56) References Cited

U.S. PATENT DOCUMENTS

| | | | | |
|---|---|---|---|---|
| 3,653,084 | A * | 4/1972 | Hartman | 441/40 |
| 3,737,930 | A * | 6/1973 | Smith, III | 5/676 |
| 3,857,126 | A * | 12/1974 | Woodruff | 5/698 |
| 3,956,782 | A * | 5/1976 | Morrison | 5/737 |
| 3,959,833 | A * | 6/1976 | Burke | 5/695 |
| 4,034,429 | A * | 7/1977 | Smith | 5/256 |
| 4,801,493 | A | 1/1989 | Ferziger et al. | |
| 5,723,507 | A * | 3/1998 | Markovich et al. | 521/51 |
| 6,025,067 | A * | 2/2000 | Fay | 428/314.4 |
| 6,078,026 | A * | 6/2000 | West | 219/212 |
| 6,306,234 | B1 | 10/2001 | Barker et al. | |
| 6,987,075 | B2 | 1/2006 | Orlandi | |
| 7,473,659 | B2 * | 1/2009 | Sytz | 442/312 |
| 7,547,650 | B2 * | 6/2009 | Keep | 442/414 |
| 2003/0100645 | A1 * | 5/2003 | Ahmed et al. | 524/306 |

OTHER PUBLICATIONS

Definition "cushioning" The American Heritage Dictionary of the English Language, Fourth Edition, Houghton Mifflin Company, 2009 (no month).*

"GRAS" Wikipedia, http://en.wikipedia.org/wiki/Generally_recognized_as_safe, 4 pages, Dec. 23, 2010.*

(Continued)

*Primary Examiner* — Andrew Piziali
(74) *Attorney, Agent, or Firm* — Norton Rose Fulbright US LLP; Scott D. Rothenberger

(57) ABSTRACT

A non-toxic mattress and method of constructing the mattress having a reduced toxicity has an outer layer of a material selected from the group comprising polyethylene and polylactic acid film. Also, a mattress cover for covering the outer layer of the mattress can also be constructed from a material selected from the same group of materials. The polyethylene and polylactic acid films are non-toxic materials which reduce adverse human allergenic reactions or exposure to potentially harmful chemicals used in the mattress construction.

7 Claims, 1 Drawing Sheet

(56) References Cited

OTHER PUBLICATIONS

FDA Code of Federal Regulations Title 21, http://www.accessdata.fda.gov/scripts/cdrh/cfdocs/cfcfr/CFRSearch.cfm?fr=177.1520, 26 pages, Apr. 1, 2010.*

FDA GRAS, http://www.fda.gov/Food/FoodIngredientsPackaging/GenerallyRecognizedasSafeGRAS/default.htm, 7 pages, Mar. 31, 2011.*

Definition of "cushion" Merriam-Webster Online (http://www.merriam-webster.com/dictionary/cushion) copyright 2011 by Merriam-Webster, Incorporated. (no month).*

GRAS Removal, Risk-Based Standard, I2P2 Floated as Diacetyl Remedies, Kristina Sherry, http://insidehealthpolicy.com/Inside-OSHA/Inside-OSHA-05/04/2010/gras-removal-risk-based-standard-i2p2-floated-as-diacetyl-remedies.html, May 4, 2010.*

Saccharin, FDA Agencies, http://enhs.umn.edu/current/saccharin/fda.html, Feb. 22, 2005.*

FDA Food Additive List, http://www.fda.gov/food/foodingredientspackaging/foodadditives/foodadditivelistings/ucm091048.htm, Jan. 19, 2012.*

* cited by examiner

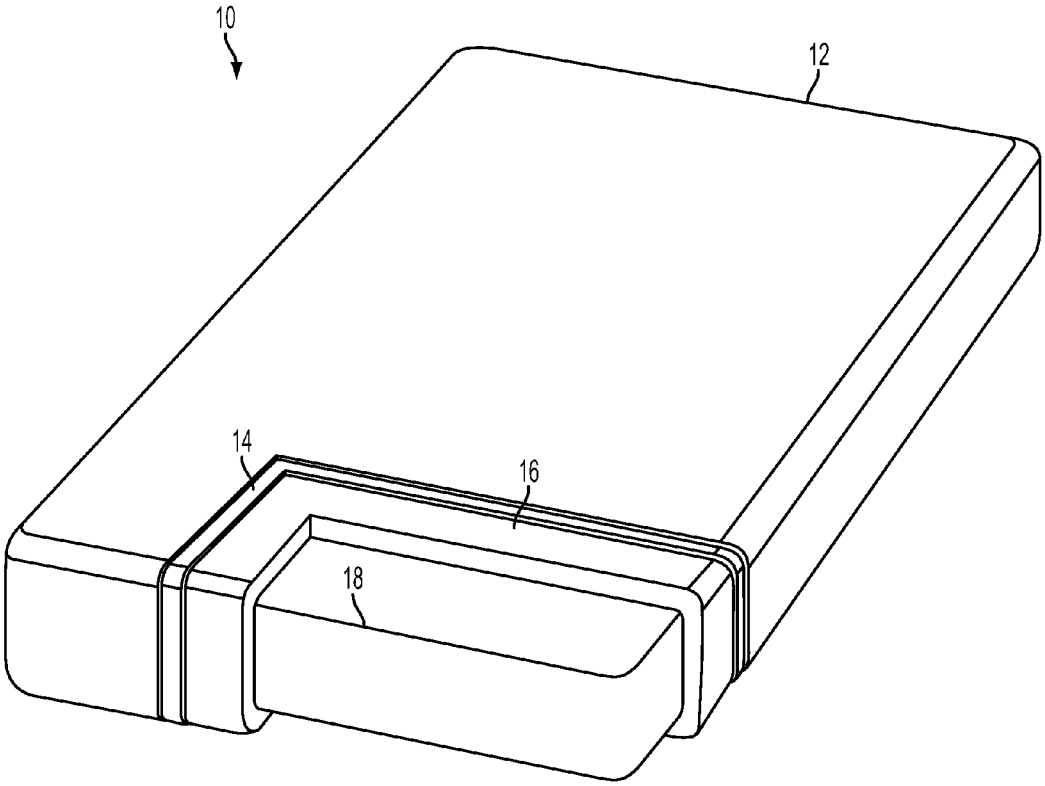
10
12
14
16
18

FOOD-GRADE POLYETHYLENE MATTRESS

CROSS-REFERENCE TO RELATED APPLICATIONS

This application claims the benefit of U.S. Provisional Patent Application No. 60/893,939, filed Mar. 9, 2007 by Barry Cik.

This application claims the benefit of U.S. Provisional Patent Application No. 60/939,418, filed May 22, 2007 by Barry Cik.

FIELD OF THE INVENTION

The present invention relates to mattress materials that significantly reduce any potential human harm due to exposure to the mattress materials. More specifically, the present invention relates to a method for processing and constructing mattress materials so as to reduce the toxicity of a mattress in order to greatly reduce the risk of adverse human allergic reaction or exposure to potentially harmful chemicals due to the materials or material impurities used in the mattress construction.

BACKGROUND OF THE INVENTION

There are various mattress constructions that use materials that, by themselves or due to some material impurities, can cause or aggravate human allergenic reactions and/or can result in other potentially harmful exposures. For example, materials that incorporate polyurethanes, polyvinyl chlorides, polystyrenes, or polycarbonates all contain volatiles and/or water soluble chemicals that are potentially harmful to human health, safety, and the environment.

A mattress cover typically is the outermost layer or combination of layers in the assembled mattress. The mattress cover functions to isolate the mattress from the human body. That is, the mattress cover is primarily used to provide a barrier between the mattress and the person, limiting deterioration of the mattress and above all preventing the passage of irritating substances, bacteria or parasites from the mattress to the person. The mattress typically contains dusty material (deriving from the natural wool or erosion of the foam rubber) which can pass through the surface of the mattress and irritate the skin. Furthermore, as time passes, the surface layers of the mattress are subject to deterioration and/or contamination with bacteria and parasites. Being that a mattress cover can be in close proximity to or in contact with a user's skin, eyes, mouth, and nostrils, it is preferable not to allow any water soluble or volatile material impurity in the mattress cover or in the mattress itself. The reason being that water soluble or volatile material impurities can be adsorbed or absorbed by the skin, mouth, and the eyes, and inhaled into the mucous membranes and the lungs. These impurities are then transported into the human bloodstream and can cause a negative effect on the user's health.

For example, the deteriorated and/or contaminated surface of the mattress cover can cause skin irritation and/or an allergic reaction. More specifically, there is a risk that the movement of air over and through the mattress cover with water soluble or volatile material impurities can transport mattress volatiles to the sensitive lungs of infants, asthmatics, or hyper-allergenic humans.

The typical exposure to a mattress used in bedding and furniture can range from about 6 hours per day for adults to as high as 18 hours or more per day for infants. Due to the typically high amount of exposure to mattress materials, there is a need for non-toxic material construction of mattress covers as well as the mattresses themselves.

The mattress covers produced so far only partly satisfy the above requirements: for example, the barrier effect is obtained by considerably increasing the thickness of the sheet or adding plastic materials. In some cases fabrics impregnated with antibacterial materials have been used but in this case the antibacterial product can be easily released, creating problems of skin toxicity and loss of the barrier effect of the cover. There is therefore a need for mattress cover sheets free from the above limitations which are able, in particular, to provide an effective barrier and at the same lime are biocompatible and comfortable for the user.

SUMMARY OF THE INVENTION

The present invention is directed to a non-toxic mattress cover constructed from food grade plastics that do not contain dyes or recycled plastic deemed harmful to humans.

The U.S. Food & Drug Administration (FDA) sets standards for plastic resins used in food packaging to be of greater purity than plastics used for non-food packaging. This is commonly referred to as food grade plastic. Food grade plastics do not contain dyes or recycled plastic deemed harmful to humans.

It has been found that mattress covers made from Food Grade Low Density Polyethylene (LDPE) or Polylactic Acid (PLA) and its copolymers or homopolymers that meet FDA standards offer a very low level of toxicity and can eliminate or reduce adverse human allergenic reactions or other potentially harmful exposures due to the mattress construction materials or their impurities, and especially when used as the mattress cover material. Even when Food Grade LDPE or PLA is used for food containers, it is not known to leach any water soluble chemicals that are suspected of causing adverse human allergenic reaction or other potentially harmful exposures.

It is also within the terms of the present invention to use starch sourced Bio-Polymer, Polylactic Acid, films and laminates to maximize the renewable and recyclable materials content.

It is also within the terms of the present invention to construct a mattress using organically grown cotton batting, in order to eliminate any possible agricultural pesticide or chemical fertilizer contamination. This cotton batting is can be treated with an ozone or other sanitizing process to clean, oxidize, and to remove other possible contaminant volatiles.

According to the present invention, there is disclosed a non-toxic mattress having a reduced toxicity. The non-toxic mattress comprises an outer layer of the mattress composed of a material selected from the group comprising polyethylene and polylactic acid film. A next lower layer of the mattress is encompassed by the outer layer. An inner cushioning layer of the mattress is encompassed by the outer layer and the next lower layer of the mattress. An innermost component of the mattress is embedded within inner cushioning layer.

Further according to the present invention, the non-toxic mattress includes a mattress cover for covering the outer layer of the mattress. The mattress cover is constructed from a material selected from the group comprising polyethylene and polylactic acid film.

Still further according to the present invention, the mattress cover is constructed of poly(lactic acid), homopolymers and copolymers of lactic acid containing at least 50 mole % lactic acid units and mixtures thereof having a number average molecular weight of 3,000-200,000.

Moreover according to the present invention, the mattress cover is constructed of a polyethelene film of Polylactic Acid which has been FDA classified as Generally Recognized as Safe (GRAS), a Food Grade Polymer and/or a Food Grade Low Density Polyethylene (LDPE).

Yet further according to the present invention, the Polyethylene film has a density is 0.85 to 1.00 grams per cubic centimeter; a maximum extractable fraction (expressed as percent by weight of the polymer) in N-Hexane at specified temperatures is 5.5% at 50 Degrees Centigrade (Deg C.); and a maximum extractable fraction (expressed as percent by weight of the polymer) in Xylene at specified temperatures is 11.3% at 25 Deg C.

Also according to the present invention, the mattress cover is constructed of poly(lactic acid), homopolymers and copolymers of lactic acid containing at least 50 mole % lactic acid units and mixtures thereof having a number average molecular weight of 3,000-200,000.

In addition, the outer layer of the mattress is constructed of Polylactic Acid which has been FDA classified as Generally Recognized as Safe (GRAS), a Food Grade Polymer and/or a Food Grade Low Density Polyethylene (LDPE) that meets FDA guideline.

Still further according to the present invention, the Polyethylene film has a density is 0.85 to 1.00 grams per cubic centimeter; a maximum extractable fraction (expressed as percent by weight of the polymer) in N-Hexane at specified temperatures is 5.5% at 50 Degrees Centigrade (Deg C.); and a maximum extractable fraction (expressed as percent by weight of the polymer) in Xylene at specified temperatures is 11.3% at 25 Deg C.

Also according to the present invention, the outer layer of the mattress can be heat fused to a non-toxic substrate within the mattress so as to provide improved tensile strength and tear resistance to the outer layer of the mattress. The non-toxic fabric substrate can be constructed of materials including cotton, polyester, polypropylene and others or combinations thereof.

Further according to the present invention, the next lower layer of the mattress is composed of a fabric flame barrier and flame retardant.

According to the present invention, the inner cushioning layer is constructed of a material selected from the group consisting of cotton batting, Food Grade Polyethylene and Food Grade Polylactide foam for providing vibration dampening, insulation, and cushioning.

Also according to the present invention, the innermost component of the mattress is constructed of a support material that gives the non-toxic mattress the necessary strength, maintains the desired shape of the mattress, provides the majority of the cushioning requirements and provides the required weight support.

Yet further according to the present invention, the mattress cover and the outer layer of the mattress is constructed of a material selected from the group consisting of starch sourced Bio-Polymer, Polylactic Acid, films and laminates to maximize the renewable and recyclable materials content.

According to the present invention, a method for constructing a non-toxic mattress having a reduced toxicity comprising the following steps. An outer layer of the mattress is formed of a material selected from the group comprising polyethylene and polylactic acid film. A next lower layer of the mattress is encompassed by the outer layer. An inner cushioning layer of the mattress is formed so that it is encompassed by the outer layer and the next lower layer of the mattress. An innermost component of the mattress is embedded within inner cushioning layer.

Further according to the present invention, the outer layer of the mattress is covered with a mattress cover constructed from a material selected from the group comprising polyethylene and polylactic acid film.

Yet further according to the present invention, the mattress cover is constructed of a polyethelene film of Polylactic Acid which has been FDA classified as Generally Recognized as Safe (GRAS), a Food Grade Polymer and/or a Food Grade Low Density Polyethylene (LDPE).

Still further according to the present invention, the outer layer of the mattress is heat fused to a non-toxic substrate within the mattress so as to provide improved tensile strength and tear resistance to the outer layer of the mattress.

Moreover according to the present invention, the next lower layer of the mattress is constructed of a fabric flame barrier and flame retardant.

Yet further according to the present invention, the mattress cover and the outer layer of the mattress is constructed of a material selected from the group consisting of starch sourced Bio-Polymer, Polylactic Acid, films and laminates to maximize the renewable and recyclable materials content.

DETAILED DESCRIPTION OF THE INVENTION

In the description that follows, numerous details are set forth in order to provide a thorough understanding of the present invention. It will be appreciated by those skilled in the art that variations of these specific details are possible while still achieving the results of the present invention. Well-known processing steps and materials are generally not described in detail in order to avoid unnecessarily obfuscating the description of the present invention.

Throughout the descriptions set forth in this disclosure, lowercase numbers or letters may be used, instead of subscripts. For example $V_g$ could be written Vg. Generally, lowercase is preferred to maintain uniform font size. Regarding the use of subscripts throughout the text of this document, sometimes a character (letter or numeral) is written as a subscript—smaller, and lower than the character (typically a letter) preceding it, such as "Vs" (source voltage) or "$H_2O$" (water). For consistency of font size, such acronyms may be written in regular font, without subscripting, using uppercase and lowercase—for example "Vs" and "$H_2O$". Materials (e.g., silicon dioxide) may be referred to by their formal and/or common names, as well as by their chemical formula. Regarding chemical formulas, numbers may be presented in normal font rather than as subscripts. For example, silicon dioxide may be referred to simply as "oxide", chemical formula SiO2. For example, silicon nitride (stoichiometrically Si3N4, often abbreviated as "SiN") may be referred to simply as "nitride".

In the description that follows, the dimensions should not be interpreted as limiting. They are included to provide a sense of proportion. Generally speaking, it is the relationship between various elements, where they are located, their contrasting compositions, and sometimes their relative sizes that is of significance.

According to the present invention, there is described materials and a process for greatly reducing the toxicity of mattress covers and mattress construction so as to reduce the risk of undesirable human allergenic reactions or other potentially harmful exposures to mattress construction materials or their impurities.

A mattress cover, according to the present invention, is constructed of Polylactic Acid which has been FDA classified as Generally Recognized as Safe (GRAS), a Food Grade Polymer and/or a Food Grade Low Density Polyethylene (LDPE) that meets either of these FDA guidelines: 177.1520, 21 CFR Ch. 1 (4-1-03 Edition) Olefin Polymers:

Section 2.1, Page 281: Polyethylene for use in articles that contact food except for articles used for packing or holding food during cooking. The Polyethylene film meets this FDA specification:

1. Density is 0.85 to 1.00 grains per cubic centimeter.
2. Maximum extractable fraction (expressed as percent by weight of the polymer) in N-Hexane at specified temperatures is 5.5% at 50 Degrees Centigrade (Deg C.).
3. Maximum extractable fraction (expressed as percent by weight of the polymer) in N-Hexane at specified temperatures is 11.3% at 25 Deg C.

OR

Section 2.3, Page 281: Polyethylene for use only as component of food-contact coatings at levels up to and including 50 percent by weight of any mixture employed as a food-contact coating. The Polyethylene film meets this FDA specification:

1. Density is 0.85 to 1.00 grams per cubic centimeter.
2. Maximum extractable fraction (expressed as percent by weight of the polymer) in N-Hexane at specified temperatures is 53% at 50 Deg C.
3. Maximum extractable fraction (expressed as percent by weight of the polymer) in Xylene at specified temperatures is 75% at 25 Deg C.

Polyethylene is a polymer consisting of long chains of the monomer ethylene (IUPAC name ethene). The recommended scientific name 'polyethene' is systematically derived from the scientific name of the monomer.

The ethene molecule (known almost universally by its common name ethylene), $C_2H_4$ is $CH_2{=}CH_2$, where two $CH_2$ groups are connected by a double bond. Polyethylene is created through polymerization of ethene.

LDPE is defined by a density range of 0.850-1.000 g/cc. LDPE has a high degree of short and long chain branching, which means that the chains do not pack into the crystal structure as well. It has therefore less strong intermolecular forces, since the instantaneous-dipole induced-dipole attraction is lower. This results in a lower tensile strength and increased ductility. LDPE is created by free radical polymerization. The high degree of branches with long chains gives molten LDPE unique and desirable flow properties. LDPE has been used for both rigid containers and plastic film applications such as plastic bags and film wrap.

Polylactic acid or Polylactide (PLA) is a biodegradable, thermoplastic, aliphatic polyester derived from renewable resources. Polylactide, (O−CH(−CH3)-C(=O)}n, is easily produced in a high molecular weight form through ring-opening polymerization using most commonly a stannous octoate catalyst, but for laboratory demonstrations, tin (II) chloride is often employed.

According to the present invention, suitable polymers for use in constructing the mattress covers and possibly part of the mattress itself are poly(lactic acid) homopolymers and copolymers of lactic acid containing at least 50 mole % lactic acid units and mixtures thereof having a number average molecular weight of 3,000-200,000.

Due to the chiral (helical) nature of lactic acid, several distinct forms of polylactide exist: poly-L-lactide (PLLA) is the product resulting from polymerization of L,L-lactide (also known as L-lactide). PLLA has crystallinity around 37%, a glass transition temperature between 50-80° C. and a melting temperature between 173-178° C. The polymerization of a racemic mixture L- and D-lactides leads to the synthesis of poly-DL-lactide (PDLLA) which is not crystalline but amorphous. The physical blend of PDLA and PLLA can be used to widen the polymer's application window.

Copolymers of lactic acid are typically prepared by catalyzed copolymerization of lactide with one or more cyclic esters and/or dimeric cyclic esters. Typical co-monomers are: glycolide (1,4-dioxane-2,5-dione), the dimeric cyclic ester of glycolic acid; β-propiolactone, the cyclic ester of 3-hydroxypropanic acid; a, a-dimethyl-β-propiolactone, the cyclic ester of 2,2-dimethyl-3-hydroxypropanic acid; β-butyrolactone, the cyclic ester of 3-hydroxybutyric acid; d-valerolactone, the cyclic ester of 5-hydroxypentanoic acid; e-caprolactone, the cyclic ester of 6-hydroxyhexanoic acid, and the lactones of its methyl substituted derivatives, such as 2-methyl-6-hydroxyhexanoic acid, 3-methyl-6-hydroxyhexanoic, 4-methyl-6-hydroxyhexanoic acid, 3,3,5-trimethyl-6-hydroxyhexanoic acid, etc., the cyclic ester of 12-hydroxydodecanoic acid; and 2-p-dioxanone, the cyclic ester of 2-(2-hydroxyethyl)-glycolic acid.

Further, according to the present invention, starch sourced Bio-Polymer, Polylactic Acid, films and laminates are selected to maximize the renewable and recyclable materials content.

The outer layer 12 of a mattress 10, according to the present invention shown in FIG. 1, is composed of Polyethylene or Polylactic Acid film that can be heat fused to cotton or other non-toxic fabric substrate within the mattress so as to provide improved tensile strength and tear resistance to the outer layer of the mattress.

The next lower layer 14 of the mattress 10, encompassed by the outer layer, is composed of an industry approved fabric flame barrier and flame retardant.

The inner cushioning layer 16 of the mattress 10, encompassed by the outer layer and the next lower layer of the mattress, is composed of organically grown and ozone treated cotton batting or cushioning layer to clean, oxidize, and to remove other possible contaminant volatiles. Alternately, the inner cushioning layer may be composed of Food Grade Polyethylene or Polylactide foam. In the foam form, the polymers of the present invention function as packaging, vibration dampening and insulation, or as a material for cushioning.

The innermost component 18 of the mattress 10, embedded within inner cushioning layer is an innerspring constructed of metal or other non-toxic polymeric support material that ensures that the mattress has the necessary strength, maintains the desired shape, provides the majority of the cushioning and functions to provide the required weight support.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. A mattress comprising:

an outer layer of the mattress composed of a Food Grade Low Density Polyethylene film;

a next lower layer of the mattress, encompassed by the outer layer;

an inner cushioning layer of the mattress, encompassed by the outer layer and the next lower layer of the mattress; and an innermost component of the mattress, embedded within the inner cushioning layer.

2. The mattress of claim 1 wherein the Food Grade Low Density Polyethylene has a density of 0.85 to 1.00 grams per cubic centimeter; a maximum extractable fraction (expressed as percent by weight of the polymer) in N-Hexane at specified temperatures is 5.5% at 50 Degrees Centigrade (Deg C); and a maximum extractable fraction (expressed as percent by weight of the polymer) in Xylene at specified temperatures is 11.3% at 25 Deg C.

3. The mattress of claim 1 wherein the outer layer of the mattress is heat fused to a substrate within the mattress so as to provide improved tensile strength and tear resistance to the outer layer of the mattress.

4. The mattress of claim 3 wherein the substrate is constructed of cotton, polyester, polypropylene and combinations thereof.

5. The mattress of claim 1 wherein the next lower layer of the mattress is composed of a fabric flame barrier and flame retardant.

6. The mattress of claim 1 wherein the inner cushioning layer is constructed of a material selected from the group consisting of cotton batting, Food Grade Low Density Polyethylene, polyethylene and Polylactide for providing vibration dampening, insulation, and cushioning.

7. The mattress of claim 1 wherein the innermost component of the mattress is constructed of a support material that maintains a shape of the mattress.

* * * * *